US005763878A

United States Patent [19]

Franzen

[11] Patent Number: 5,763,878

[45] Date of Patent: Jun. 9, 1998

[54] METHOD AND DEVICE FOR ORTHOGONAL ION INJECTION INTO A TIME-OF-FLIGHT MASS SPECTROMETER

[75] Inventor: Jochen Franzen, Bremen, Germany

[73] Assignee: Bruker-Franzen Analytik GmbH, Bremen, Germany

[21] Appl. No.: 620,803

[22] Filed: Mar. 28, 1996

[30] Foreign Application Priority Data

Mar. 28, 1995 [DE] Germany ..... 195 11 333.0

[51] Int. Cl.[6] ..... B01D 59/44; H01J 49/00

[52] U.S. Cl. ..... 250/292; 250/282; 250/287

[58] Field of Search ..... 250/282, 287, 250/288, 292

[56] References Cited

U.S. PATENT DOCUMENTS

| | | | |
|---|---|---|---|
| 4,486,664 | 12/1984 | Wollnik | 250/292 |
| 5,070,240 | 12/1991 | Lee et al. | 250/287 |
| 5,117,107 | 5/1992 | Gullhaus et al. | 250/287 |
| 5,420,425 | 5/1995 | Bier et al. | 250/292 |
| 5,569,917 | 10/1996 | Buttrill et al. | 250/292 |
| 5,572,022 | 11/1996 | Schwartz et al. | 250/292 |
| 5,572,035 | 11/1996 | Franzen | 250/292 |
| 5,576,540 | 11/1996 | Jolliffe | 250/292 |

FOREIGN PATENT DOCUMENTS

| | | |
|---|---|---|
| 0529885 | 3/1993 | European Pat. Off. . |
| 1537250 | 12/1978 | United Kingdom . |
| 2233149 | 6/1989 | United Kingdom . |

OTHER PUBLICATIONS

Erol E. Gulcicek et al., *Detector response in time–of–flight mass spectrometry at high pulse repetition frequencies*, American Institute of Physics, pp. 2382–4284, May 7, 1993.

Michael et. al., "An Ion Trap Storage/Time of Flight Mass Spectrometer", *Rev. Sci. Inst.*, vol. 63, Oct. 1992.

*Primary Examiner*—Bruce Anderson

[57] ABSTRACT

The invention relates to methods and devices for the orthogonal injection of ions into a time-of-flight mass spectrometer, whereby the ions preferably originate from ion sources which are located outside of the vacuum system of the mass spectrometer. The invention consists of first introducing the ions into a multipole rod arrangement with extended pole rods which stretches orthogonally to the flight direction of the ions in the time-of-flight spectrometer, and then outpulsing the ions by means of a rapid change of the electrical field, perpendicular to the rod direction, through the intermediate space between two rods. The multipole arrangement can take the form of an ion storage device by fitting reflectors to the ends. The multipole arrangement can be filled with the aid of another multipole arrangement which takes the form of an ion guide. Damping of the ion oscillations with the aid of a collision gas leads to a collection of ions in a very thin thread on the axis of the multipole arrangement, providing the time-of-flight spectrometer with an excellent mass resolving power due to the uniform initial energy and low energy spread of the ions.

17 Claims, 2 Drawing Sheets

METHOD AND DEVICE FOR ORTHOGONAL ION INJECTION INTO A TIME-OF-FLIGHT MASS SPECTROMETER

SUMMARY

The invention relates to methods and devices for the orthogonal injection of ions into a time-of-flight mass spectrometer, whereby the ions preferably originate from ion sources which are located outside of the vacuum system of the mass spectrometer.

The invention consists of first introducing the ions into an RF multipole rod arrangement with extended pole rods which stretches orthogonally to the flight direction in the time-of-flight spectrometer, and then outpulsing the ions by means of a rapid change of the electrical field, perpendicular to the rod direction, through the intermediate space between two rods. The multipole arrangement can take the form of an ion storage device by fitting reflectors to the ends. The multipole arrangement can be filled with the aid of another multipole arrangement which works as an ion guide. Damping of the ion oscillations by a collision gas leads to a collection of ions in a very thin thread on the axis of the multipole arrangement, providing the time-of-flight spectrometer with an excellent mass resolving power due to the low spatial spread and low velocity spread of the ions.

PRIOR ART

Time-of-flight mass spectrometers are preferably operated with ion sources that generate the ions in a very brief timespan of only a few nanoseconds. Lasers are most often used for this, the flashes of which can be compressed into such a brief timespan with relative ease.

The simple design of the time-of-flight mass spectrometer and its practically unlimited mass range, as well as the advancements in electronics toward very fast data collection systems, make it increasingly desirable to also be able to use such spectrometers for ion sources with continuous ion generation. It is particularly desirable to use the spectrometers for ions which are generated outside the vacuum system of the mass spectrometer. In this case the ions can originate from continuously or intermittently functioning ion sources: since the ions are necessarily subjected to a broad distribution of transfer times during their transfer from atmospheric pressure into the vacuum, because of many diffusion processes, the difference between continuous and intermittendly operating ion sources is of no consequence in practical application. Preferred ion sources of this type are electrospray sources which can ionize molecules of extremely high molecular weight, ranging up to several hundred thousand atomic mass units. For such heavy ions, there is practically no mass spectrometric principle available other than that of the time-of-flight spectrometer.

But in order to again impress a pulsed starting time on the ions in the spectrometer, two methods have been used up to now:

(a) collection of the ions in three-dimensional RF quadrupole ion traps with fast outpulsing, and (b) injection of ions in the form of a fine ion beam orthogonally to the flight direction in the spectrometer, and outpulsing of the fine ion beam toward the flight path of the spectrometer, whereby the reflector and deflector must be set up with a large surface and parallel to the ion front.

DISADVANTAGES OF PREVIOUS TECHNIQUES

Both methods have serious disadvantages.

The capture of ions in a three-dimensional quadrupole RF ion trap leads to a cloud of ions with strong oscillations of the ions. The diameter of the ion cloud and the velocities of the ions at the moment of outpulsing lead to very poor mass resolution, unacceptable for this type of mass spectrometry. It is however known that the ions can be concentrated into a relatively small cloud of about one to two millimeters diameter by introducing a collision gas to decelerate all oscillations. (In fact it is only by means of a collision gas that a satisfactory capture of ions can be attained at all). However, the damping time is between 5 and 20 milliseconds, depending on the density of the collision gas, and even longer for very heavy ions. In order to attain good outpulsing, the collision gas must be pumped back out again after the oscillations have been decelerated, which in turn requires 10 to 50 milliseconds depending on the density of the collision gas. In this way, the repetition rate of the procedure is reduced to about 20 to 100 spectra per second at the most, and therefore also the sensitivity of the mass spectrometric measurement is reduced. However, a repetition rate of 10,000 spectra per second is desirable for the scanning, particularly since the dynamic range within the individual spectrum is very limited due to the fast converters, limited to 8 bits. Scanning of a time-of-flight spectrum takes less than 100 microseconds. Modern accumulative transient recorders can attain a repetition rate of 10,000 accumulated spectra per second, and therefore also a better dynamic range. Only at such a scanning rate can a good utilization of ions from the ion source be attained.

Orthogonal injection in the form of a fine ion beam has completely different disadvantages and problems. If the ions from an ion source outside the vacuum are channeled, together with neutral gas, into the vacuum of the mass spectrometer, they receive, due to the isentropic expansion of the neutral gas in the form of a jet, a gas-dynamic acceleration at the end of the capillary which leads to a wide distribution of ion velocities at a medium velocity, practically independent of mass. Thus the ions do not have any uniform initial energy, and the initial energy is extremely dependent upon mass. They are also accelerated into an aperture angle of about 10°. Such an ion beam cannot be satisfactorily focused through electrical fields due to its mass-dependent energy non-uniformity. Ultimately, production of the fine ion beam is therefore possible only by masking, whereby only a very small share of ions of about 0.01 to 0.5% of the ions pass into the beam. A drastic reduction in sensitivity is connected with this.

However the transfer of ions into a fine beam can be considerably improved if the ions are captured behind the first gas skimmer of a differential pump arrangement by an RF ion guide made up of extended pole rods. Since this ion guide starts in a chamber of the differential pump arrangement, the movements of the ions can be damped by collisions with the neutral gas in this differential pump chamber. The ions which have been thermalized in this way essentially have an equal and narrow distribution of energy, and their average energy is very reduced. Due to the narrow diameter of these ion guides, the ions emerging from the end form an almost pointed source. The ions can then be transferred very easily into a fine beam by ion-optical means and with a high yield.

In this case, the uniform energy of the ions is disadvantageous. The initial energy distribution, as well as the energy added by the ion-optical means, leads to a mass-dependent ion velocity within the fine gas jet. In order to attain a satisfactorily fine beam, about 3 electron volts of energy must at least be invested. The outpulsing path within the fine gas jet is generally limited to about 5 centimeters. If, however, heavy ions of 40,000 atomic mass units have exactly filled this path of 5 centimeters, light ions of 100 atomic mass units have already flown 100 centimeters due to their 20-fold velocity. In this 5 centimeter outpulse path, they are depleted by a factor of 20. The depletion is even more drastic if there is also a starting path before the outpulsing path which must be bridged. The spectra therefore show considerable mass discrimination.

If the ions are however outpulsed toward the flight path of the spectrometer, they will indeed be accelerated at a right angle, but not outpulsed at a right angle. They maintain their original velocity perpendicular to the flight path, creating an oblique ion beam, with its deviation from 90° dependent upon the mass of the ions. This too produces mass discrimination.

In U.S. Pat. No. 5,117,107 (Guilhouse), this effect is again rectified by injection which is not exactly orthogonal. However it is disadvantageous here that this rectification only be achieved for ions of a previously selected mass, since the deflection angles, as result from the above remarks, are mass-dependent This arrangement is only advantageous for the masked gas jet of a spectrometer without an ion guide, the velocity of which is essentially independent of the mass.

OBJECTIVE OF THE INVENTION

A method and a device must be found with which ions from a continuously functioning ion source, preferably an ion source outside the vacuum, can be assembled at the starting point of a time-of-flight spectrometer in such a way that they can be outpulsed at a high clock-pulse rate and with good properties for high mass resolving power.

BRIEF DESCRIPTION OF THE INVENTION

It was the aim of the invention to somehow join together the two methods (a) and (b), i.e. the method of an ion trap with practically stationary ions and sudden outpulsing, and the method of a fine ion beam. This aim however requires a completely different type of ion trap than that of a three-dimensional RF quadrupole ion trap, as has been used exclusively up to now.

It is therefore an idea of the invention to store the ions in an RF multipole arrangement of pole rods. It is a further idea of the invention to provide the multipole arrangement with reflecting diaphragms on the end surfaces, in order to be able to store the ions for a longer period without mass-dependent losses. It is a further idea of the invention to outpulse the ions from this ion trap perpendicularly through the pole rods, either through the gap between adjacent rods, or through a slit in one of the rods.

The ions must be stored in the form of a thin thread in the axis of the arrangement so that they are located as exactly as possible at the same potential for the outpulsing, and the must show almost no initial velocities. To store ions in the form of a thin thread, it is necessary to cool the movement of the ions with a collision gas. Cooling within the multipole arrangement itself is, as shown above, very disadvantageous.

It is therefore a further idea of the invention to cool the ions in a second, coaxial multipole arrangement, and only then feed them axially into the first ion trap at the front end of the time-of-flight spectrometer. However, to avoid periodic pumping out, it is a further idea of the invention to cool the ions permanently by the presence of a collision gas in a section of this second, extended multipole arrangement, and to use a further part of this multipole arrangement, in an area with a good vacuum, only for transfer of the cooled ions to the first ion trap. It is a further idea of the invention to utilize, for the cooling, the increased pressure within a chamber of a differential pump unit, which is necessary in any case for the introduction of ions from an area of higher pressure into the vacuum system of the mass spectrometer.

FURTHER ADVANTAGES OF THE INVENTION

It is a great technical advantage of this invention to be able to make this storage arrangement much shorter than the length which would correspond to the outpulsing path of normal orthogonal injection. The latter is usually about 4 to 6 centimeters long and therefore requires detectors with quite a large surfaces, and also very large diameter reflectors in case of beam reflection. With an RF multipole arrangement, the outpulsing path can be limited without disadvantage to about 1 centimeter, so that standard, commercially built time-of-flight mass spectrometers can be used without modifications to the design. The limit for the shortness of the outpulsing path is determined only by the maximum capacity for loading with ions and the space charge which thereby results. As described below, 10,000 ions represent, for technical reasons, approximately the upper limit for charging. These can be stored in a multipole of one centimeter length without any substantial impairment due to space charge.

PARTICULARLY FAVORABLE EMBODIMENTS

The embodiments described here are represented with an Electrospray Ion Source (1, 2) outside the vacuum housing of the mass spectrometer. Nevertheless, the invention is expressly not limited to this type of ion generation. For other types of ion sources, inside or outside the vacuum system, a specialist can easily make the appropriate changes.

The ions are obtained from an Electrospray Ion Source (1) by spraying fine droplets of a liquid into air (or nitrogen) from a fine Capillary (2) under the influence of a strong electrical field, whereby the droplets are vaporized and their charge remains on detached molecules. In this way, very large molecules, ranging up to several ten thousand or several hundred thousand atomic mass units, can be very easily ionized.

The ions from this ion source are usually introduced into the vacuum of the mass spectrometer by a Capillary (3) with an inside diameter of about 0.5 millimeters and a length of about 100 millimeters. They are entrained by the simultaneously in-flowing air (or by a different gas, fed to the surrounding area of the entrance) via gas friction. A differential pump unit with two Intermediate Stages (4) and (7) takes over the evacuation of the arising gas. The ions entering through the capillary are accelerated within the First Chamber (4) of the differential pump unit within the isentropic expanding gas jet and drawn by an electrical field to the opposite aperture of a Gas Skimmer (5). The Gas Skimmer (5) is a conical point with a central hole, whereby the outer cone wall deflects the flow of gas toward the outside. The aperture of the gas skimmer guides the ions, now with much less accompanying gas, into the Second Chamber (7) of the differential pump unit.

Figure 1:
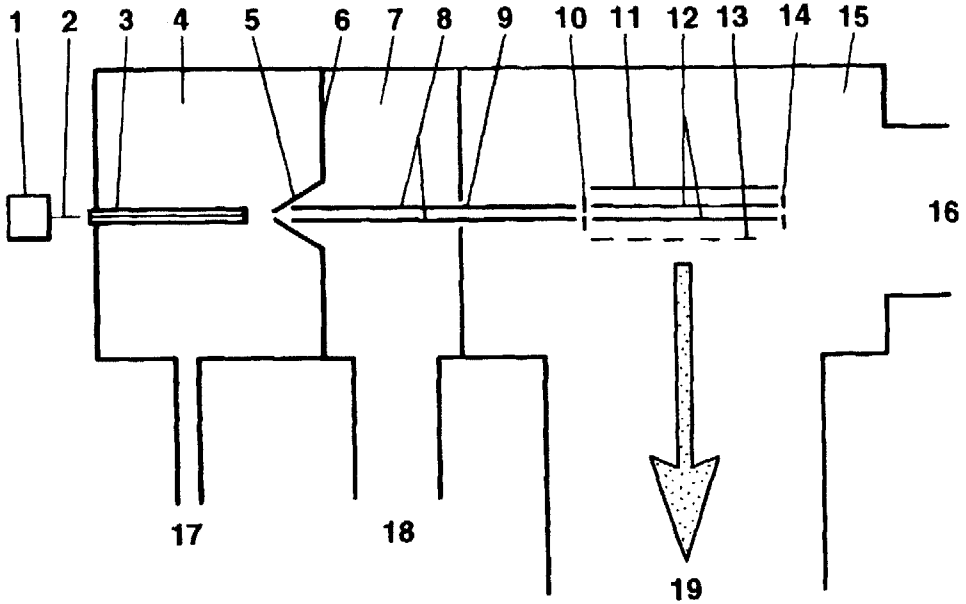
FIG. 1 shows the head of a a time-of-flight mass spectrometer, with an arrangement made up of an external electrospray ion source, a differential pump unit, an ion guide, and an ion trap according to this invention. Supply tank (1) contains a liquid which is sprayed by means of electrical voltage between the fine Spray Capillary (2) and the end surface of the Entrance Capillary (3). The ions enter through the Entrance Capillary (3), together with ambient air into the differential first Pump Chamber (4), which is connected via the Flange (17) to a forevacuum pump. The ions are accelerated toward the Skimmer (5) and enter the Second Chamber (7) of differential evacuation through the aperture in the Skimmer (5) located in the Partition (6). This Second Chamber (7) is connected to a high vacuum pump by the Pump Flange (14). The ions are accepted by the Ion Guide (8) and led through the Wall Opening (9) and the Main Vacuum Chamber (15) to the Ion Trap (12). The ion trap has two Aperture Diaphragmas (10) and (14) on both ends, which enclose the ions in the trap, and which are spaced about 14 millimeters from one another. The length of the ion thread for outpulsing is then about 10 millimeters. The Ion Trap (12) is enclosed between the Ion Repeller (11) and the Drawing Diaphragm (13), which serve to accelerate the outpulsed ions. The ions are accelerated toward the Flight Tube (19) of the spectrometer, the arrow indicates the flight direction in the time-of-flight spectrometer. The Main Vacuum Chamber (15) is connected to a high vacuum pump via the Pump Flange (16).
Figure 2:
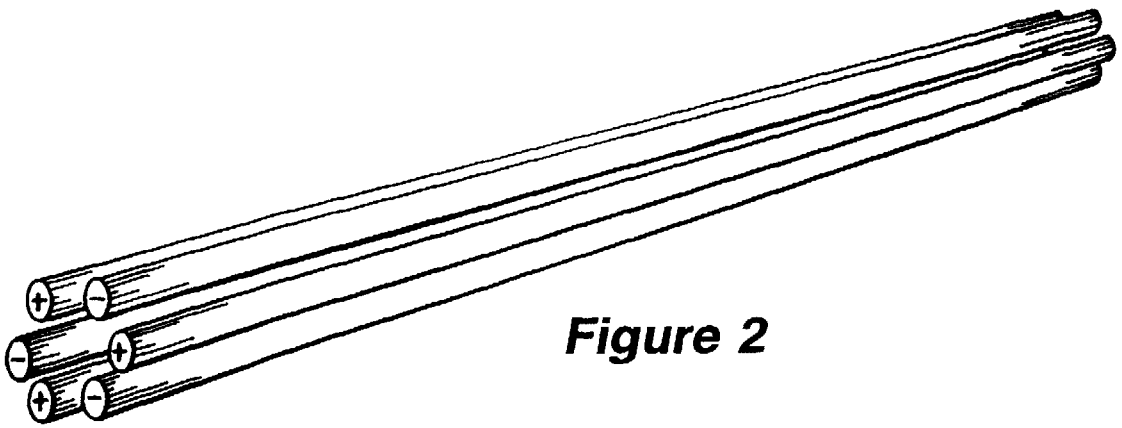
FIG. 2 shows an ion guide in the form of a hexapole. The polarity of the RF voltage to be applied is indicated on the end surfaces of the rods. The holders for the rods are not shown for reasons of better clarity.

The Ion Guide (8) starts directly behind the aperture of the Gas Skimmer (5). This preferably consists of a linear hexapole arrangement (FIG. 2), which here consists of six thin straight rods arranged uniformly around the circumference of a cylinder. It is however also possible to use a curved ion guide with curved pole rods, for example, to eliminate neutral gas especially well. The rods are supplied with an RF voltage, whereby the phase between adjacent poles changes respectively. The poles are supported at several places by insulating units.

The particularly favorable embodiment has rods 150 millimeters long of 1 mm diameter each, and the enclosed cylindrical guiding space has a diameter of only 2.5 millimeters. The ion guide is therefore very slender. Experience shows that the ions which are introduced through a skimmer hole with 1.2 millimeter diameter are accepted by this ion guide practically without loss, if their mass is greater than the cutoff limit. This unusually good scanning rate is primarily due to the gas-dynamic conditions at the entrance aperture.

At a frequency of about 3.5 megahertz and a voltage of about 600 volts, all singly charged ions with masses greater than 150 atomic mass units are focused within the ion guide. Lighter ions escape the ion guide. Using other voltages or frequencies, the cutoff limit for the ion masses can be adjusted to any desired value.

The Ion Guide (8) leads from the aperture in the Gas Skimmer (5), which is arranged as part of the Wall (6) between the First (4) and Second Chamber (7), through this Second Chamber (7) of the differential pump unit, and through a Wall Opening (9) into the Main Vacuum Chamber (15) of the mass spectrometer up to the Entrance Diaphragm (10) of the Ion Trap (12) according to this invention. Due to the slender embodiment of the ion guide, the Wall Opening (9) can be kept very small, which therefore allows the pressure difference to remain favorably high. The ion guide, in its preferable embodiment, is already in the form of an ion storage device. The Entrance Diaphragm (10) of the Ion Trap (12) with the injection hole for the ions, which preferably has a diameter of about 1 millimeter, thereby serves as the first ion reflector, the other ion reflector being formed by the Gas Skimmer (5) with its through hole of 1.2 millimeter diameter.

By changing the potential on the axis of the Ion Guide (8) relative to the potential of the Skimmer (5) and the Entrance Diaphragm (10), the Ion Guide (8) can be used as a storage device for ions of one polarity, that is, either for positive or negative ions. The potential on the axis is identical to the zero potential of the RF voltage. The stored ions constantly run back and forth in the Ion Guide (8).

Since they attain a velocity of about 500 to 1,000 meters per second or more in the isentropric acceleration phase, they first sweep through the length of the ion guide several times per millisecond. Their radial oscillation within the ion guide is dependent upon the injection angle.

However, since the ions periodically return to the Second Chamber (7) of the differential pump unit, in which there is a pressure of between 10-2 and 10-3 millibar, the radial oscillations are very quickly damped, and the ions assemble on the axis of the ion guide. During each run through this section of the ion guide, the ions are subjected to hundreds of collisions and thermalization is therefore very rapid. Their longitudinal movement is also decelerated to thermal velocities. The ions therefore achieve a thermal distribution of velocity after a short time, usually after the first sweep through this section.

By changing the potential on the axis or the potential of the Entrance Diaphragm (10), the stored ions can be made to flow into the Ion Trap (12). The outflow backwards into the Chamber (4) is thereby almost completely prevented by numerous collisions with the inflowing gas. Reverse outflow can also be prevented by asymmetrical potentials of both ion reflectors, Skimmer (5) and Entrance Diaphragm (10).

The ion source can particularly be coupled with devices for sample separation, for example with capillary electrophoresis. Capillary electrophoresis then delivers time-separated substances in very brief time intervals with heavy concentration. The intermediate storage of ions can then be very favorably implemented in order to retain the ions of one substance for several fillings of the ion trap, whereby numerous MS/MS analyses of daughter ion spectra of different parent ions become possible if the time-of-flight spectrometer has a corresponding collision chamber or fragmentation. The electrophoretic process can easily be interrupted for longer lasting analyses by switching off the voltage intermittently.

But of course ion sources which are inside the vacuum housing of the mass spectrometer can also be connected to the Ion Trap (12) via storing ion guides. Here too, ions from time-separated substance peaks, such as are developed during couplings with chromatographic or electrophoretic processes, can be retained for several analyses in the ion trap.

The ion trap, according to the invention, consists of the Multipole Arrangement (12) and the two Aperture Diaphragms (10) and (14), which are spaced at a distance of about 14 millimeters. The diaphragms serve simultaneously as holders for the pole rods, by means of small insulators. The pole rods each have a diameter of about 1 millimeter with an inner storage compartment diameter of 4 millimeters. The Entrance Diaphragm (10) has an aperture of only about 1 millimeter, in order to only allow axis proximal ions through. To fill the Ion Trap (12), the Entrance Diaphragm (10) can be lowered to a suitable potential. Ions which have not yet been thermalized have even stronger oscillations perpendicular to the axis of the ion guide, and are only allowed through to a very limited extent. The Terminating Diaphragm (14) has a much larger aperture of about 2.5 millimeters, and is switched in such a way that only thermal ions are held back In this way, the few non-thermal ions which penetrate through Aperture (10) leave the Ion Trap (12) again through Aperture Diaphragm (14).

Filling the Ion Trap (12) takes less than 100 microseconds. In this way, an outpulsing rate of 10,000 outpulses per second can be maintained.

The Ion Trap (12) can be designed as a hexapole, or also as a quadrupole. An embodiment as an octopole is not advantageous, since the ions are then no longer definitely arranged in one area in the form of a thin thread, but are rather able to occupy a more extensive area due to space charge. Therefore during the outpulsing, they are all disadvantageously not at uniform potential.

Figure 3:
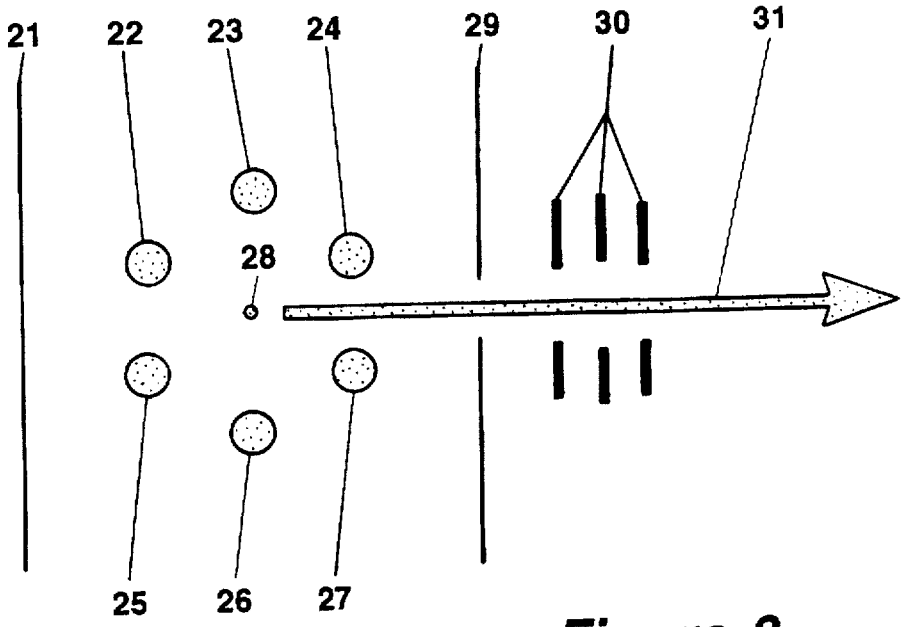
FIG. 3 shows a section through the Ion Trap (12) of FIG. 1 according to the invention which here is in the form of a hexapole with the Pole Rods (22) to (27). The hexapole arrangement is located between the Ion Repeller (21) and the Ion Drawing Diaphragm (29), spaced about 12 millimeters from one another. The hexapole arrangement houses the Ion Cloud (28) formed as a thin thread which is made up of well-cooled ions. In storage conditions, one phase of the storage RF voltage is applied to Pole Rods (22), (24), and (26), and the other phase to Pole Rods (23), (25), and (27). Ions of both polarities can be stored. To outpulse positive ions, a more positive voltage is applied to Pole Rods (22) and (25), a more negative voltage to Rods (24) and (27) than to Rods (23) and (26). The Ion Drawing Diaphragm (29) is designed as a slit diaphragm through which all ions can be accelerated without loss. Slight beam divergencies can be focused through the cylindrical Einzel Lens (30) into a parallel beam. Arrow (31) indicates the flight direction within the time-of-flight spectrometer.

In FIG. 3, the outpulsing through the hexapole rods is indicated. The hexapole arrangement is exactly at the center between the Repeller (21) and Ion Drawing Diaphragm (29), and is half as wide as the distance between the Repeller (21) and Drawing Diaphragm (29), which are spaced at a distance of about 12 millimeters. Repeller (21) and Drawing Diaphragm (29) are at a uniform potential during filling, advantageously at the potential of ion acceleration. The RF voltage on the pole rods also has its center potential at this ion acceleration potential. Before the outpulsing of the ions, the Ion Trap (12) is first closed by raising the potentials of the Aperture Diaphragms (10) and (14). No further ions can penetrate; the Ion Cloud (28) in the trap is stored as a thin thread near the axis. For the outpulsing, the storage RF is stopped in the zero sweep of its phases, the Repeller (21) is switched to double acceleration potential, Pole Rods (22) and (25) to one and a half times, Pole Rods (23) and (26) are left at acceleration potential, Pole Rods (24) and (27) are switched to half acceleration potential, and the Ion Drawing Diaphragm (29) to the zero potential of the flight tube. In this way, an approximately uniform electrical acceleration field results for the ions between the Repeller (21) and Drawing Diaphragm (29), ideal for a time-of-flight spectrometer. The cylindrical Einzel Lens (30) can be used to focus slight divergence of the beam into a parallel beam.

If different voltage relationships are set, the ions are in this way not accelerated within a homogeneous field between the Repeller (21) and Drawing Diaphragm (29), but rather in two different fields. Coordination of these two different acceleration fields can be used for second order focusing in a linear time-of-flight spectrometer.

Figure 4:
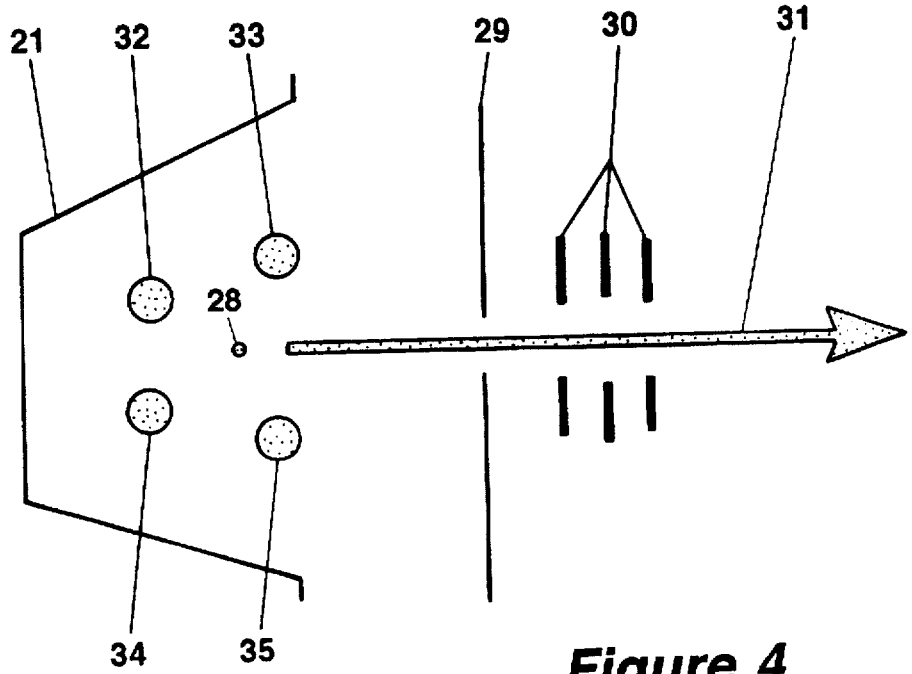
FIG. 4 shows a quadrupole arrangement made up of Pole Rods (32) to (35). The pole rods are arranged asymmetrically here in order to cause outpulsing solely through the external electrical field between the Ion Repeller (21) and Ion Drawing Diaphragm (29), without special voltages on the Pole Rods (32) to (35), the RF voltage of which is simply switched off.

Switching of the pole rods to the above high DC voltage potentials is technically not easy, therefore it is practical to select a different arrangement in which only the RF voltage is stopped in the zero sweep to outpulse the ions. Such an arrangement is shown in FIG. 4 in the form of a distorted quadrupole arrangement. The two pole rods pointing to the Drawing Diaphragm (29), have a wider spacing here. In this way, an outside field can penetrate more easily. Additionally, this enlarged spacing causes the Ion Thread (28) to shift more closely to the Drawing Diaphragm (29). The Repeller (21) is led around the quadrupole arrangement. If the RF voltage is stopped in the zero sweep for outpulsing, and the Drawing Diaphragm (29) is switched to the potential of the flight tube, the Ions (28) are thus drawn out by the penetrating drawing field and accelerated. In this way, focusing is stronger than in the case of FIG. 3, which however can be refocused out through the Cylindrical Einzel Lens (30). Once the slowest ions have escaped the acceleration area, the ion trap can be switched back to filling. Here too, a second order focusing can be achieved here through the non-homogeneous acceleration field.

There are numerous other multipole rod arrangements which can be used according to this invention. The specialist in the field is quite capable to implement these. As an example, the ions can be pulsed out through a slit in one of the rods. In fact, the rods must not be cylindrical rods, hyperbolically shaped surfaces on rods are still more favorable. Even hyperbolically bent sheet metal foils can be used.

The outpulsing can occur at a repetition rate of 10,000 cycles per second. In conjunction with an accumulative transient recorder, spectra can be added up at a rate of 10,000 spectra per second. Selectively, the sum spectra can be read out after 100, 250, 1,000 or 2,500 additions, resulting in sum spectra rates of 100, 40, 10 or 4 per second. Other values can also be set if desired.

Accumulative transient recorders in the clock-pulse range of 100 to 500 megahertz have been dependent up to now on analog to digital converters with 8 bit data width. If the preamplifiers are adjusted so that each ion corresponds to about one unit count of the converter, no more than 255 ions can thus be offered in one time channel, because otherwise a converter saturation would occur. However, since the ions of one mass are distributed over several time channels, ion fillings with 1,000 ions can certainly be endured without saturation, even if this only concerns one spectrum with only one type of ion. Since large ions are practically always of organic origin, the isotope pattern always distributes the ions over several ion masses. The ion fillings can in this way become even greater, perhaps up to 10,000 ions per filling. 10,000 ions still cause no difficulties due to space charge effects, even if they are stored on a path of only 1 centimeter. On the other hand, just less than 0.1 ion per filling, accumulated over 1,000 scans, can produce easily interpretable spectra from 100 ions. In spite of the 8 bit converter, the time-of-flight mass spectrometer operated in this way shows quite an impressive dynamic measuring range of about 5 orders of magnitude for an operating mode at 10 sum spectra per second.

I claim:

1. An ion trap for introducing ions into a flight path of a time-of-flight mass spectrometer, the ion trap comprising:

a plurality of parallel pole rods that extend orthogonally to the flight path, the pole rods being arranged about a central axis of the trap;

a damping mechanism by which to reduce the kinetic energy of the ions;

a voltage source capable of supplying electrical voltage to each of the pole rods; and a voltage controller for controlling the voltages on the pole rods, the magnitude, frequency and phase of the voltages on the rods being controllable by the controller, the controller providing at least two predetermined voltage arrangements, a first one in which the voltages on the rods cause ions to assemble along the central axis of the trap, and a second one in which the voltages of the rods contribute to an ejection of ions from the trap toward the flight path of the spectrometer.

2. An ion trap according to claim 1 wherein the voltages applied to the pole rods can be switched in such a way that the ions are outpulsed orthogonally to the central axis.

3. An ion trap according to claim 1, wherein conductive elements are located near the flight path, and predetermined voltages applied to the conductive elements support outpulsing and allow acceleration of the outpulsed ions.

4. An ion trap according to claim 1 further comprising aperture diaphragms at both ends of the rods, each of which, when provided with a first electrical potential reflects ions and, when provided with a second electrical potential, allows ions to pass through.

5. An ion trap according to claim 1 further comprising an ion guide located adjacent to and coaxial with the ion trap which transports ions to the ion trap.

6. An ion trap according to claim 5, wherein the ion guide is coaxial with one or more of a set of input apertures, input capillaries, and skimmers, through which ions from a location outside of the vacuum system can pass into the vacuum system together with neutral gas.

7. An ion trap according to claim 1, wherein the ion trap is a quadrupole ion trap with four pole rods.

8. An ion trap according to claim 1, wherein the ion trap is a hexapole ion trap with six pole rods.

9. A method of providing a controlled transfer of ions to a desired ion flight path, the method comprising:

directing the ions to a multipole ion trap having a plurality of extended pole rods that extend orthogonally to the flight path and are arranged symmetrically about a central axis;

reducing the kinetic energy of the ions;

applying a predetermined set of voltages to the pole rods that causes the ions to assemble along the central axis; and modifying the voltages on the pole rods such as to contribute to an ejection of the ions toward the flight path of the spectrometer.

10. A method according to claim 9 further comprising confining the ions within the multipole rod ion trap using one of a reflecting diaphragm or an apertured diaphragm at each end of the ion trap.

11. A method according to claim 9, wherein ejection of ions from the ion trap is orthogonal to the central axis.

12. A method according to claim 9, wherein ejection of the ions further comprises applying an RF voltage to the pole rods in a predetermined manner and, when the RF voltage sweeps through zero volts, quickly changing the electrical field around the ion trap.

13. A method according to claim 9 further comprising filling the ion trap with ions from a coaxially arranged ion guide comprising an RF multipole arrangement with extended pole rods.

14. A method according to claim 13, wherein reducing the kinetic energy of the ions comprises reducing the kinetic energy of the ions in the ion guide with a collision gas.

15. A method according to claim 14, wherein filling the ion trap from an ion guide comprises filling the ion trap from an ion guide that passes through chambers of a differential pump arrangement, the relatively high gas pressure of the chambers causing said reducing of the kinetic energy of the ions.

16. A method according to claim 13 further comprising directing ions and neutral gas from outside the vacuum system to the vacuum system via an aperture leading to the ion guide.

17. A method according to claim 16, wherein directing the ions through said aperture comprises directing the ions through the canal of a capillary.

* * * * *